United States Patent [19]

Boismenu

[11] 4,237,621

[45] Dec. 9, 1980

[54] DAMPER STRUCTURE FOR A CLOTHES DRYER VENT

[76] Inventor: Lucien Boismenu, 5635 Wolseley, Cote St. Luc, Montreal, Quebec, Canada, H4W 2L4

[21] Appl. No.: 40,189

[22] Filed: May 18, 1979

[51] Int. Cl.[3] ..... F26B 19/00

[52] U.S. Cl. ..... 34/108; 34/140; 34/133; 34/235; 34/243 R; 98/119; 137/527

[58] Field of Search ..... 98/119; 137/527, 527.2, 137/527.8; 251/298; 34/86, 243, 140, 130, 108, 235, 133

[56] References Cited

U.S. PATENT DOCUMENTS

| | | | |
|---|---|---|---|
| 3,541,945 | 11/1970 | Wexler | 98/119 |
| 4,156,973 | 6/1979 | Bede | 34/86 |

*Primary Examiner*—Larry I. Schwartz

[57] ABSTRACT

A damper structure for a clothes dryer vent is disclosed. The damper structure comprises a support member adapted to be inserted inside the dryer vent adjacent the inside wall of a house, and a damper plate mounted on the support member, so as to form a closed air space between the damper plate and the regular closure damper of the dryer vent for minimizing heat losses through the dryer vent. In order to fit a dryer vent of circular cross-section, the damper structure comprises a central damper element hinged at the top of the support structure and two lateral damper elements hinged one on each side of the central damper element for allowing full opening of the damper plate into the tubular dryer vent.

3 Claims, 4 Drawing Figures

DAMPER STRUCTURE FOR A CLOTHES DRYER VENT

This invention relates to a damper structure for a clothes dryer vent and, more particularly, to a damper structure adapted to be inserted in a regular dryer vent adjacent the inside wall of the house for providing a closed space between the regular damper of the dryer vent, which is located outside the house, and the damper structure of the present invention for cutting down heat losses through the dryer vent.

BACKGROUND OF THE INVENTION

Dryer vents are regularly used for directing exhaust air from clothes dryers to the outdoor atmosphere. The outside damper of the regular dryer vent, when operating properly, closes automatically by gravity when the dryer is not in operation for preventing cold air from getting inside the dryer and, eventually, inside the house in the winter. However, the cold barrier formed by the damper is very crude and a substantial amount of cold air penetrates inside the house through the dryer vent. Now that great emphasis is placed on energy saving, it becomes important to cut down heat looses, wherever possible, and this would certainly include the energy loss through clothes dryer vents.

SUMMARY OF THE INVENTION

It is therefore the object of the present invention to provide a damper structure for use with the regular dryer vent, which will cut down heat losses by a substantial amount.

The vent structure in accordance with the invention comprises a support member adapted to be inserted inside the dryer vent adjacent the inside wall of a house and a damper plate mounted on the support member, so as to form a dead air space between the damper plate and the regular closure damper of the dryer vent for minimizing heat losses through the dryer vent.

The conventional dryer vents are of circular cross-section and, for allowing full opening of the damper plate inside the tubular dryer vent, the damper structure preferably comprises a central damper element hinged on the top of the support member and two lateral damper elements hinged one on each side of the central damper element.

SHORT DESCRIPTION OF THE DRAWINGS

The invention will now be disclosed, by way of example, with reference to the accompanying drawings, in which.

DETAILED DESCRIPTION OF A PREFERRED EMBODIMENT

Figure 1:
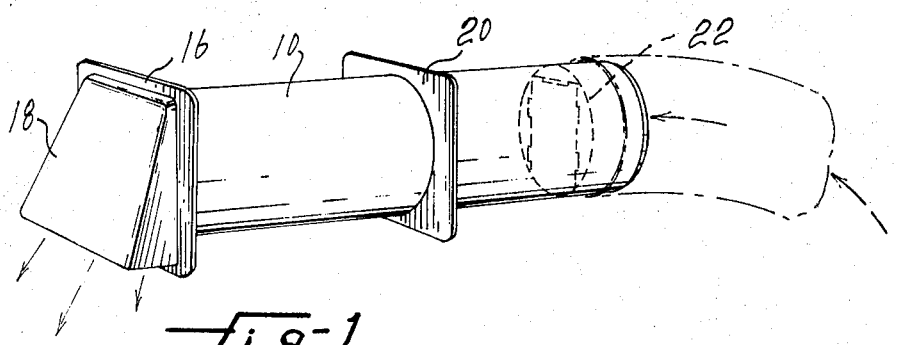
FIG. 1 illustrates a perspective view of a conventional dryer vent provided with the damper structure in accordance with the invention.

Referring to the drawings, there is shown a known dryer vent comprising a pipe 10 passing through a hole in the outside wall 12 of a house. The pipe is closed outside the wall 12 by a damper plate 14 hingedly mounted on a flange 16, which is permanently, or removably secured thereto. The damper plate is covered by a hood 18 in a conventional manner. As it is well known, the damper plate opens under pressure when the dryer is in operation and closes by gravity when the dryer is cut off. A second flange 20 is located around the pipe 10 inside the wall 12, also in a conventional manner.

Inside the above-known dryer vent, is installed a damper structure in accordance with the invention and comprising a support member 22 in the shape of a short cylindrical element adapted to fit tightly inside the pipe 10 adjacent the inside surface of the wall 12. The cylindrical element 22 has a narrow flange 24, which extends inwardly all around the edge thereof and is somewhat wider at the top. A damper plate 26 is pivotally mounted on the upper portion of the flange 24 of the cylindrical element through a hinge lug 28, which fits into an opening 30 in the damper plate. The damper plate 26 is made of three elements: a central, generally rectangular damper element 32 and two lateral, segment shaped damper elements 34, which are hinged to the central damper element through hinge lugs 36 inserted into openings 38 in the sides of the central damper element 32. The lateral damper elements 34 are provided with tabs 40 which abut against the edges of the central damper element when the damper is closed, to prevent the lateral damper elements from rotating outwardly more than a required amount. The lateral damper elements 34 will remain in a plane parallel to the plane of the central damper elements with the edge 42 of the lateral damper elements in contact with flange 24 of the cylindrical element 22 when the damper plate is closed.

Figure 2:
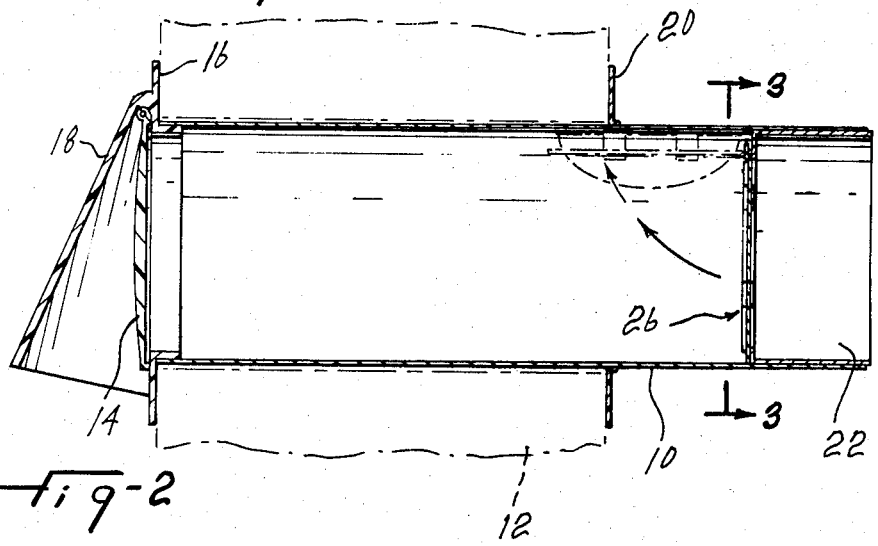
FIG. 2 illustrates a longitudinal sectional view through the dryer vent shown in FIG. 1.
Figure 3:
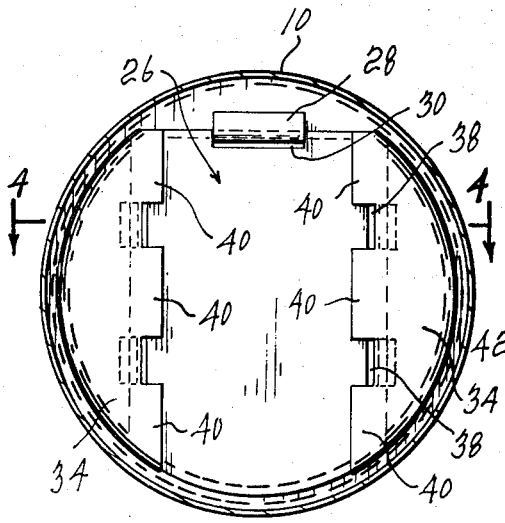
FIG. 3 shows a cross-section taken through line 3—3 of FIG. 2.
Figure 4:
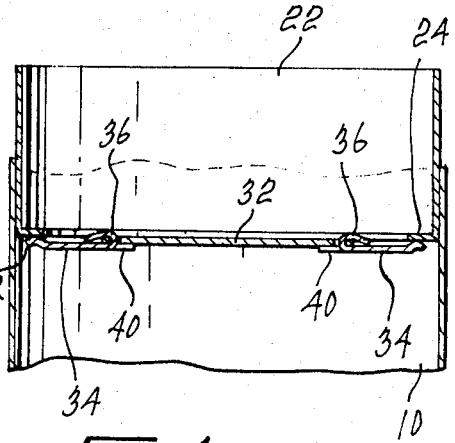
FIG. 4 shows a section taken through line 4—4 of FIG. 3.

The above-disclosed damper structure operates as follows:

When the dryer starts blowing air, the damper plate opens to a fully horizontal position, as shown in FIG. 2, because the lateral damper elements 34 will hinge downwardly around the edge of the central element 32. When the dryer stops, the damper plate will fall under gravity and the edge of the central element, as well as the edge 42 of the lateral damper elements, will tightly contact the flange 24 of the cylindrical element 22 to close the dryer vent.

The damper structure forms a closed air space between the outside damper plate 14 and the inside damper plate 26, and thus provides good insulation in between the two plates. This arrangement prevents a great loss of heat. The three-section damper plate permits installation of the damper structure into a conventional tubular dryer vent without restricting the flow of air through the dryer vent.

Although the invention has been disclosed with reference to a preferred embodiment, it is to be understood that it is not restricted to such embodiment and that other alternatives are also envisaged. For example, any type of support member amy be used for supporting the damper plate inside the dryer vent. Other suitable means may be used to ensure that the several sections of the damper plate will tightly close the dryer vent. Finally, the damper plate may be used for other vents such as a kitchen hood vent which is normally equipped with a single damper plate.

What I claim is:

1. A damper structure for a clothes dryer and the like tubular vent of circular cross-section and equipped with an outside closure damper, comprising:

(a) a support member adapted to be inserted inside the vent adjacent the inside wall of a house; and (b) a damper structure mounted on said support member so as to form a closed air space between said damper structure and the closure damper of the vent for minimizing heat losses through the vent, wherein said damper structure comprises a central damper element hinged on the top of the support member, and two lateral damper elements hinged one on each side of said central damper element for allowing full opening of said damper plate into the tubular vent.

2. A damper structure as defined in claim 1, wherein said support is in the shape of a short cylindrical element adapted to tightly fit inside the vent and has a narrow inwardly extending flange, and said lateral damper elements include hinge lugs for allowing pivotal of the lateral damper elements around the edges of the central damper element when the damper is open, and lateral tabs contacting the edge of the central damper element for maintaining the lateral damper elements in a tight closing position against said narrow flange in the closed position of said damper plate.

3. A damper structure as defined in claim 2, wherein said central damper element is generally rectangular and each lateral damper element has the shape of a segment of a circle.

* * * * *